US008646143B2

(12) United States Patent
Lokkinen

(10) Patent No.: US 8,646,143 B2
(45) Date of Patent: Feb. 11, 2014

(54) POWER TRANSMISSION DEVICE AND POWER TRANSMISSION METHOD

(75) Inventor: Mika Lokkinen, Porvoo (FI)

(73) Assignee: Picote Oy Ltd, Porvoo (FI)

( * ) Notice: Subject to any disclaimer, the term of this patent is extended or adjusted under 35 U.S.C. 154(b) by 0 days.

(21) Appl. No.: 13/580,823

(22) PCT Filed: Feb. 9, 2011

(86) PCT No.: PCT/FI2011/050112

§ 371 (c)(1),
(2), (4) Date: Aug. 23, 2012

(87) PCT Pub. No.: WO2011/104432

PCT Pub. Date: Sep. 1, 2011

(65) Prior Publication Data

US 2012/0312910 A1 Dec. 13, 2012

(30) Foreign Application Priority Data

Feb. 24, 2010 (FI) ..... 20105181
Feb. 24, 2010 (FI) ..... 20105182

(51) Int. Cl.

| | |
|---|---|
| ***B08B 9/045*** | (2006.01) |
| ***F16C 1/00*** | (2006.01) |
| ***E03F 9/00*** | (2006.01) |
| ***B65H 75/36*** | (2006.01) |

(52) U.S. Cl.

USPC ..... 15/104.33; 242/557; 242/615.3; 242/232; 242/233; 242/390; 242/390.2; 242/390.8; 242/390.5; 254/134.3 FT

(58) Field of Classification Search

USPC ..... 15/104.09, 104.095, 104.31, 104.33; 242/557, 533.8, 403, 615.3, 232, 233, 242/604, 604.1, 390, 390.2, 390.5, 390.6, 242/390.8; 254/134.3 R, 134.3 FT

See application file for complete search history.

(56) References Cited

U.S. PATENT DOCUMENTS

| | | | | |
|---|---|---|---|---|
| 1,044,920 | A | 11/1912 | Schilow | |
| 2,008,100 | A * | 7/1935 | Ford | 15/104.03 |
| 2,075,215 | A * | 3/1937 | Magruder | 15/104.33 |
| 3,007,186 | A | 11/1961 | Olsson | |
| 3,039,715 | A * | 6/1962 | Caperton | 242/387 |
| 3,162,878 | A | 12/1964 | Agostino | |
| 3,370,599 | A | 2/1968 | Ciaccio | |
| 3,469,273 | A * | 9/1969 | Caperton | 15/104.33 |
| 3,928,885 | A | 12/1975 | Peterson et al. | |
| 4,773,113 | A | 9/1988 | Russell | |
| 5,181,668 | A | 1/1993 | Tsuji et al. | |
| 5,265,301 | A * | 11/1993 | Irwin | 15/104.33 |
| 5,810,277 | A * | 9/1998 | Cielker et al. | 242/395 |
| 5,875,508 | A | 3/1999 | Hale | |

(Continued)

FOREIGN PATENT DOCUMENTS

| | | |
|---|---|---|
| CH | 693588 | 10/2003 |
| EP | 1375763 | 1/2004 |

(Continued)

*Primary Examiner* — Mark Spisich
(74) *Attorney, Agent, or Firm* — Fasth Law Offices; Rolf Fasth

(57) ABSTRACT

The invention presents a power transmission device comprising a cable, and a duct at least partially surrounding the cable, a reel, into which the cable with its duct can be reeled, a guide for feeding the cable onto and/or off the reel, and a crank in connection with the head end of the cable for rotating the cable. The power transmission device is mainly characterized in that the crank is a hydraulic crank.

11 Claims, 3 Drawing Sheets

(56) References Cited

U.S. PATENT DOCUMENTS

Figure 1:
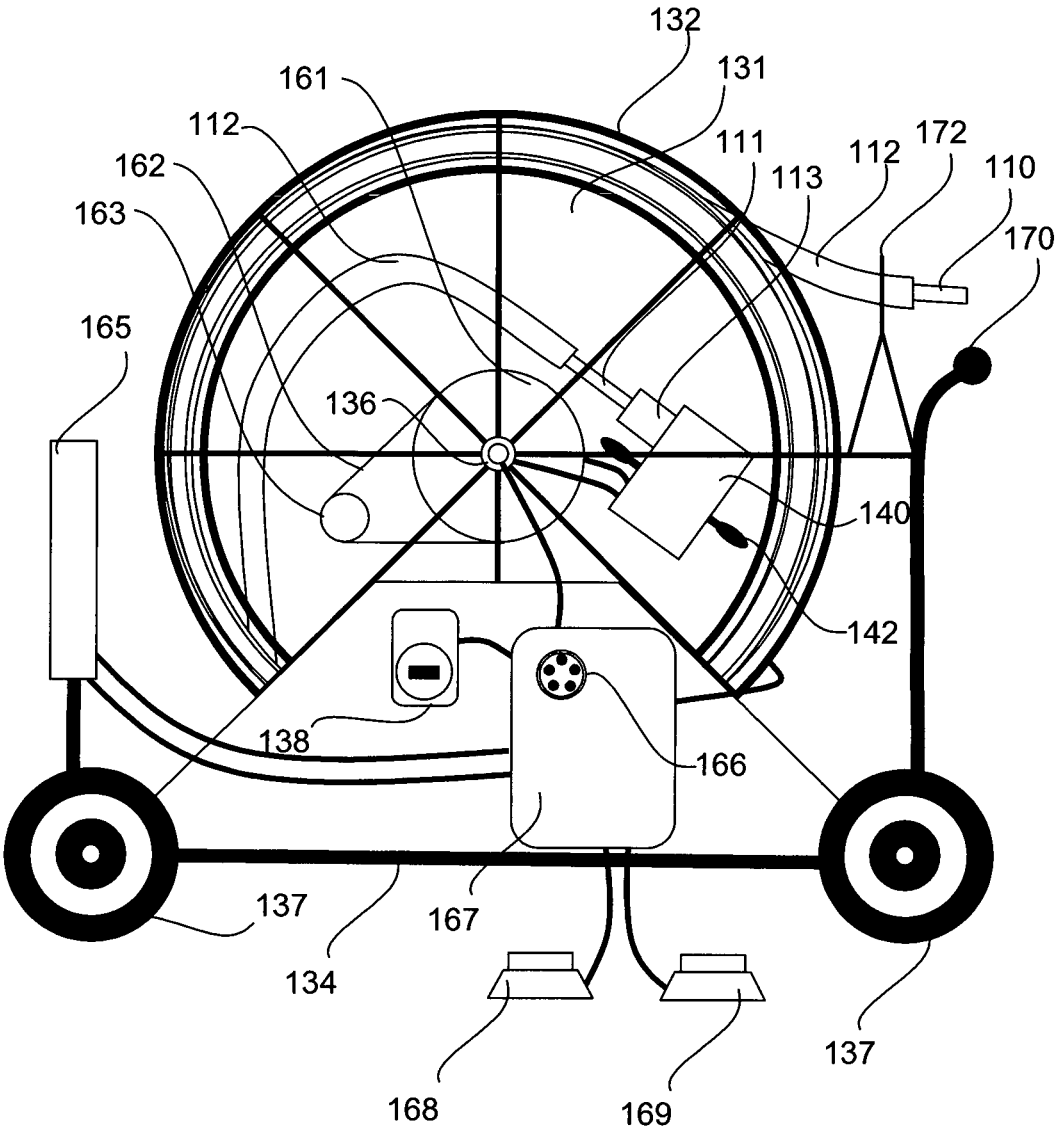

| | | | |
|---|---|---|---|
| 2005/0193509 | A1 | 9/2005 | Rutkowski et al. |
| 2006/0195994 | A1 | 9/2006 | Hung |
| 2008/0244816 | A1 | 10/2008 | Babb et al. |

FOREIGN PATENT DOCUMENTS

| | | |
|---|---|---|
| FI | 108408 | 1/2002 |
| GB | 2122712 | 1/1984 |
| WO | 0138016 | 5/2001 |

* cited by examiner

POWER TRANSMISSION DEVICE AND POWER TRANSMISSION METHOD

FIELD OF THE INVENTION

The invention relates to a power transmission device, which can be used as an aid, for example, in machining the inner surface of pipes. The invention further relates to a power transmission method.

PRIOR ART

In power transmission devices of prior art, in which power is transferred by means of the rotary movement of an elongated power transmission organ, an electric motor is typically used to generate power. By the rotary movement of the power transmission organ, for example, a cable, power is transmitted to provide a rotary movement of a tool positioned at an end of the cable. The application possibilities of a power transmission device equipped with an electric motor are limited by the inadequate torque it generates, wherein the device cannot be used for machining large pipes having, for example, a diameter of 20 cm. Furthermore, devices equipped with an electric motor get very hot during heavy use, wherein they cannot be used continuously for long periods of time without significantly shortening the service life of the device.

Alternatively, with objects requiring great force and/or torque, a water turbine driven device in connection with a water tank can be used, wherein the water pumped through the device rotates the turbine, and, at the same time, the tool connected to it. Devices of this type can be used as an aid in cleaning the inner surfaces of large pipes, such as, for example, sewer trunk lines and ground sewers.

The problem is that, in practice, the turbine-based solution requires a tank lorry specially equipped for this purpose, for example, a sewage suction truck, which is especially large-sized and thus difficult to take into tight spaces, for example, the interiors of buildings. Furthermore, the turbine-based solution also uses an extremely large volume of water as it operates, and even then it leaves a rust layer on the inner surface of the pipe, which must be removed if, for example, there is a desire to coat the inside of the pipe.

OBJECT OF THE INVENTION

The object of the invention is to present a power transmission device producing an adequate torque, and a power transmission method, which does not consume water when operated.

BRIEF DESCRIPTION OF THE INVENTION

A first aspect of the invention is a power transmission device, which comprises a cable, and a duct at least partially surrounding the cable, a reel, into which the cable with its duct can be reeled, a guide for feeding the cable onto and/or off from the reel, and a crank in connection with the head end of the cable for rotating the cable. The power transmission device is mainly characterized in that said crank is a hydraulic crank.

In one embodiment, said reel is arranged to be rotated by an electric motor.

In one embodiment, the electric motor arranged for rotating said reel is guided by pedals.

In one embodiment, said crank is attached in connection with the reel and arranged to rotate along with the reel.

In one embodiment, in connection with said crank and the head end of the cable, there is a safety switch, which disconnects the cable from the crank if torsion exceeds a limit.

In one embodiment, in connection with said cable, there are means for attaching a tool.

In one embodiment, said device further comprises means for cooling the hydraulic fluid.

In one embodiment, the reel that is arranged to be rotated has an outer ring and an inner ring, wherein the cable with its duct can be reeled into the space between the inner and outer rings.

In one embodiment, the difference between the radii of the outer ring and inner ring of the reel is less than double in relation to the diameter of the duct to be used.

In one embodiment, the device further comprises a frame, and triple wheels in connection with the frame for moving the device.

In one embodiment, the rotation axle of the reel is arranged substantially vertically in relation to the base, onto which the device is placed when the device is in the operating position.

A second aspect of the invention is a method for transmitting power using a device according to the first aspect of the invention.

One preferred embodiment of the device and the method presented is described in the following detailed description of the invention.

DETAILED DESCRIPTION OF THE INVENTION

Figure 2:
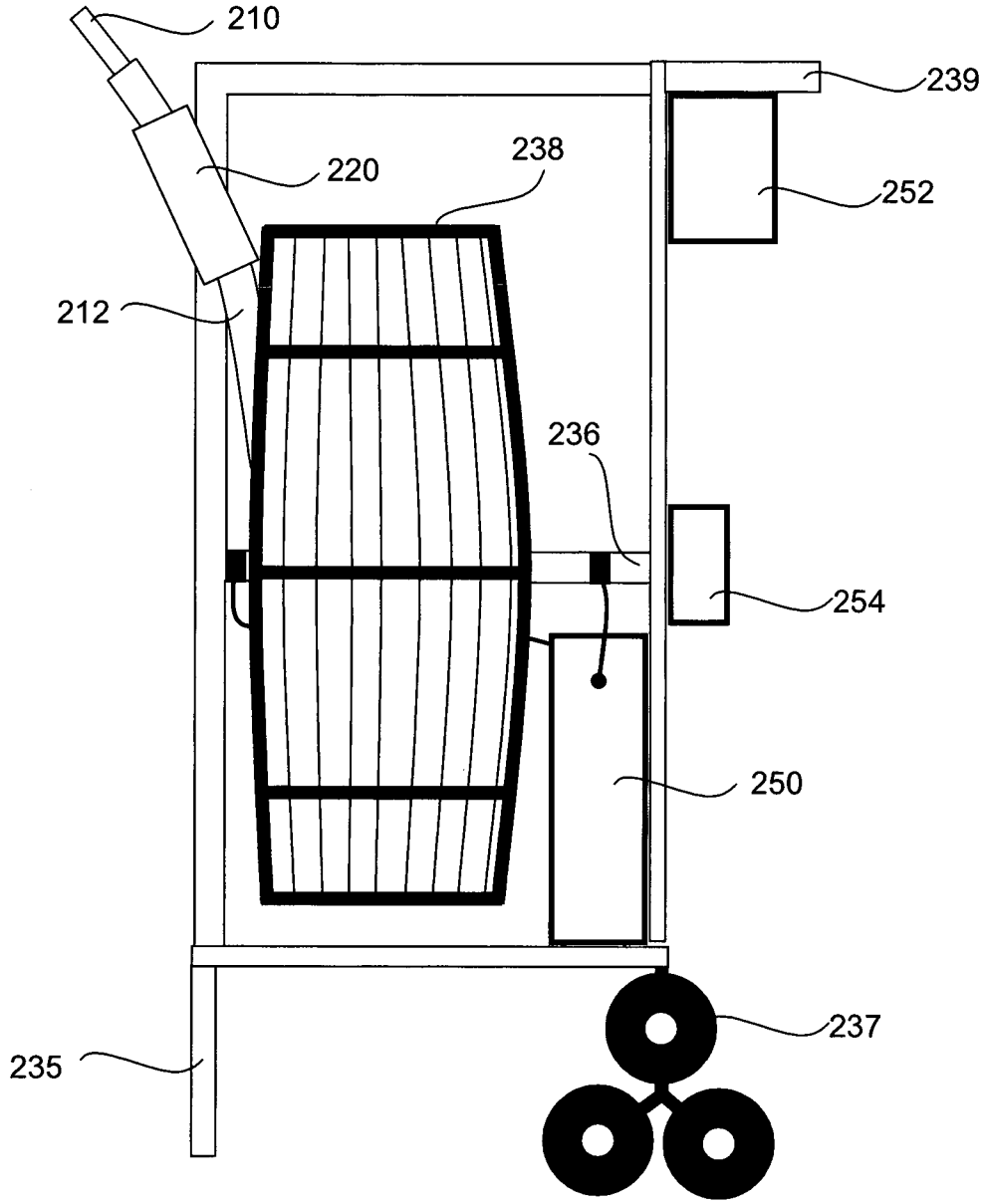
Figure 3:
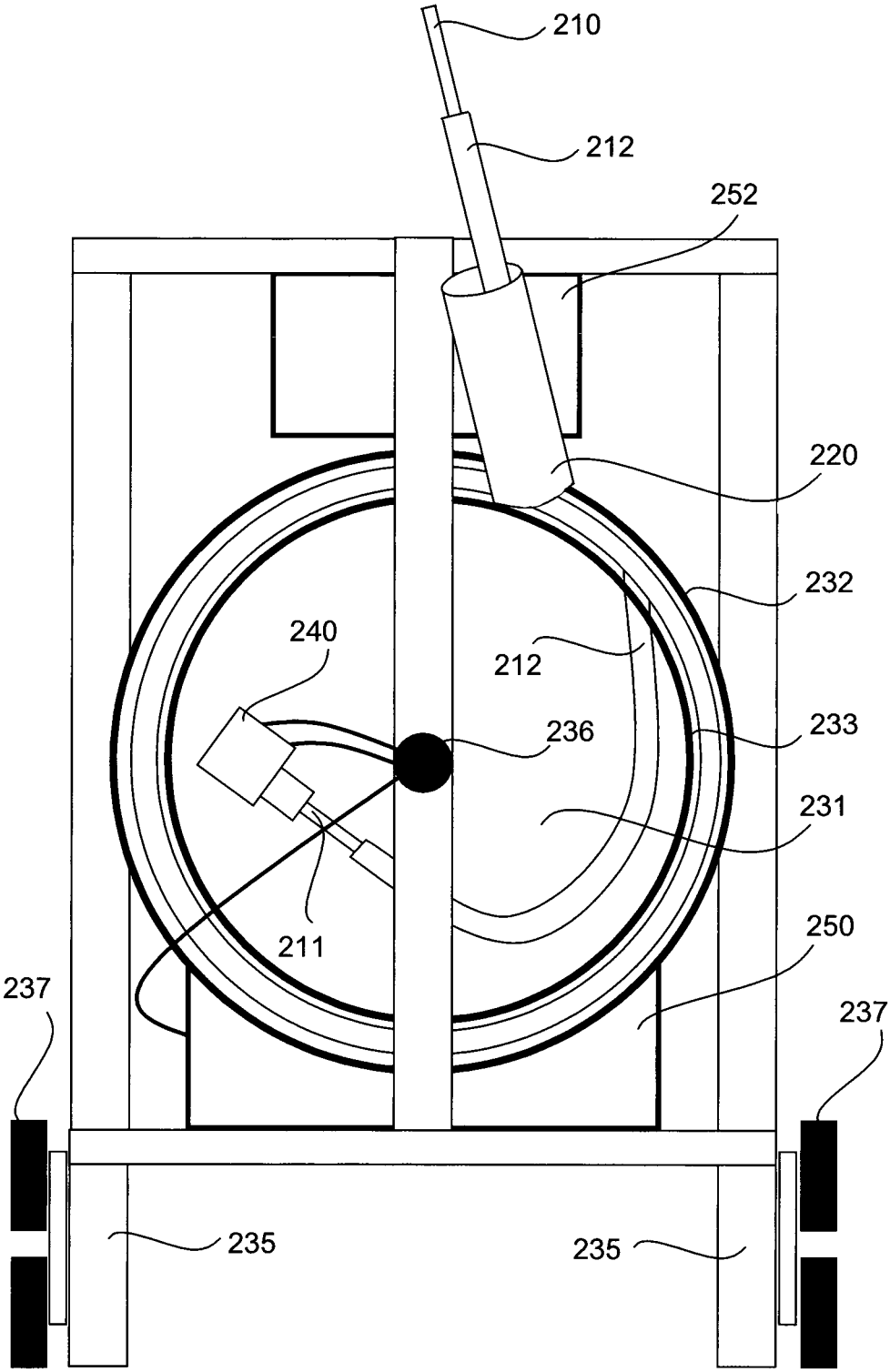

In the following, the invention is described in greater detail with reference to the exemplified preferred embodiments and accompanying figures, in which:

FIG. 1 shows a power transmission device according to one embodiment of the invention, FIG. 2 shows a power transmission device according to another embodiment of the invention as a side view in the transport position, and FIG. 3 shows a power transmission device according to another embodiment of the invention as a top view in its operating position.

FIG. 1 shows the power transmission device according to one embodiment of the invention. The device according to the embodiment has a frame 134, which is preferably light and durable, for example, made of metal pipes or metal bars. The frame is preferably carriage-like and, in connection with it, there are wheels 137 and possibly also a shaft 170 to facilitate moving the device. In connection with the frame, there is arranged a reel 132, which can be rotated due to an axle 136. The axle can be bearing-mounted, in order that the reel rotates more easily. In connection with the axle 136, there is a cogged drive gear 161, which is rotated by the motor 163 via the chain 162. In place of the chain 162, a belt may also be used and, in connection with it, a drive gear without cogs 161. The motor 163 can be, for example, electrically or hydraulically operated.

Rotation of the motor 163, and thus also of the reel 132, is guided preferably by pedals 168 and 169, wherein the reel will rotate counter-clockwise when pushing one of them and clockwise when pushing the other. Thus, at least a portion of the power transmission means 110 within the duct 112 on the reel winds onto the reel or unwinds from the reel. Power transmission takes place by means of the power transmission means 110, henceforth referred to as a cable. In place of the cable, some other flexible, but torsionally rigid means may also be used. The thickness of the cable may be, for example, 10, 12, 14, 16 or 18 mm or some other thickness appropriate for the intended use. With the exception of its open heads, the cable 110 is inside the duct 112, within which it is able to rotate as needed. At the tail end of the cable, there can be means for attaching a tool to the cable. The duct is of a flexible material, such as plastic, rubber or a mixture thereof. The cable 110 travels preferably through the guide 172, which is, for example, a loop made from a pipe or bar.

In the inner portion 131 of the reel, there is a crank 140, which is attached with attachment means 142 either directly to the reel or to its baseplate such that the crank rotates along with the reel. The lowermost duct in the reel is turned inside the reel and the head end 111 of the cable is arranged to be attached to the crank 140. As the crank rotates the head end 111 of the cable, the torsionally rigid cable 110 within the duct 112 rotates and, at the same time, rotates a tool possibly attached to the tail end of the cable. In connection with the head end of the cable, there is preferably a safety switch 113, which breaks or opens if torsion grows too high, for example, as a result of the cable becoming jammed. The safety switch prevents the creation of additional damage by disconnecting the cable from the crank. Disconnection may be implemented by physically detaching the cable from the crank or by preventing the transmission to the cable of the rotational movement of the crank or a part thereof.

The crank 140 is preferably a hydraulic crank for generating a high torque. The required circulation of hydraulic fluid to the crank and back is implemented through the axle 136 using connectors suitable for this purpose, wherein the rotation of the reel does not create a problem. In order to cool the hydraulic fluid, there is, in connection with the device, a cooling unit 165, which is preferably equipped with a fan. Due to the cooling unit, the device can be used for long periods of time without it overheating. Other hydraulic parts and connections are preferably in a control element 167. In connection with the control element 167, there is also an electric plug 166, a power switch 138 and pedals 168, 169 for controlling the motor 163.

FIG. 2 shows the power transmission device according to another embodiment of the invention as a side view in the transport position. In the device according to the embodiment, there are, in connection with the frame, legs 235, triple wheels 237 and a drawbar 239. The device is preferably arranged so light in structure and/or in its parts that a single user can move it to its operating site. Due to the triple wheels, the device is easily transported even on stairs without carrying the device. In place of the triple wheels, single wheels or some other wheel solution suitable for this purpose may be used. In the transport position, the device stands supported by its triple wheels 237 and its legs 235. In the operating position, the drawbar 239 is lowered to the ground, wherein the device stands supported by the drawbar and the triple wheels.

In connection with the frame, there is arranged a reel 238, which can be rotated due to the axle 236. In the operating position, the axle is substantially perpendicular in relation to the ground, floor or other base, onto which the device is placed for operation, wherein feeding of the duct 212 onto the reel and off the reel is easily accomplished. The axle can be bearing-mounted to make the reel rotate more easily. In connection with the reel 238 and/or axle 236, there can also be a motor 254, which rotates the reel and thus feeds the duct off the reel or gathers it onto the reel.

Preferably, the device has a hydraulic element 250 for generating hydraulic power at least to the crank, wherein a high torque is produced. The hydraulic element 250 further comprises means for cooling the hydraulic fluid so that, if needed, the device may be used continuously for long periods of time. The hydraulic fluid is transported to the crank and back into the hydraulic element 250 within the axle 236 using connectors in the axle suitable for this purpose. The device further includes a control device 252 for using a possible motor 254 and the crank.

FIG. 3 shows the power transmission device according to another embodiment of the invention as a top view in its operating position, or as a front view in its transport position.

Power transmission takes place by means of the power transmission means 210, henceforth referred to as the cable. In place of the cable, other flexible, but torsionally rigid means may also be used. The thickness of the cable can be, for example, 10, 12, 14, 16 or 18 mm or some other thickness suitable for the intended use. With the exception of its open ends, the cable 210 is inside the duct 212, within which it is able to rotate as needed. At the tail end of the cable, there can be means for attaching a tool to the cable. The duct is of a flexible material, for example, plastic, rubber or a mixture thereof. The cable 210 travels through a guide 220, which is, for example, a pipe or loop. The guide 220 guides the cable within the duct 212 onto the reel 238 as the cable is pushed inward and feeds the cable off the reel as it is pulled. Due to the rigidity of the cable and the reel to be rotated, the cable is easy to feed onto or off the reel even for great distances by handling only the cable and/or its duct.

Preferably, the difference between the radii of the outer ring 232 and inner ring 233 of the reel is less than double in relation to the diameter of the duct 212 to be used, wherein two ducts cannot fit side-by-side but a duct being reeled in always sets on top of the previous layer. Thus, the duct cannot become jammed onto the reel but it moves easily onto the reel and can also be easily pulled off the reel. The combination of the cable and duct is preferably rigid enough that, as it is pushed onto the reel, the reel rotates in response to the cable being pushed onto the reel. This makes the device especially easy to use and enables a single person to operate the device, even at some distance from the frame and reel themselves. The inner and outer rings of the reel have preferably rungs that keep the wire and duct substantially between the inner and outer rings. In place of the rungs, a disc-like solution may also be used.

The inner portion 231 of the reel has a crank 240, which is attached to the reel or its baseplate such that the crank rotates along with the reel. The crank 240 is preferably a hydraulic crank for generating a high torque. The lowermost duct within the reel is turned inside the reel and the head end 211 of the cable is arranged to be attached to the crank 240. Due to the high torque generated by the crank a safety switch is preferably used in connection with the head end of the cable, the switch breaking or opening if torsion grows too high, for example, as a result of the cable becoming jammed. The safety switch prevents the creation of additional damage by disconnecting the cable from the crank. Disconnection may be implemented by physically detaching the cable from the crank or by preventing the transmission to the cable of the rotational movement of the crank or a part thereof.

The required circulation of hydraulic fluid to the crank is implemented through the axle 236, wherein the rotation of the reel does not create a problem. The crank rotates the cable, which rotates within the duct, and, thus, the crank causes rotation also of the tail end of the cable and a tool possibly attached to it. Due to its high torque, the power transmission device according to the embodiment is suitable for use in cleaning large pipes, such as sewer trunk line pipes, when equipped with a suitable tool.

One embodiment of the invention is a power transmission device comprising a cable 210, and a duct 212 at least partially surrounding the cable, a reel 238 that is arranged to be rotated and having an outer ring 232 and an inner ring 233, wherein the cable with its duct can be reeled into the space between the inner and outer rings, a guide 220 for feeding the cable onto and/or off the reel, and a crank 240 in connection with the head end 211 of the cable for rotating the cable, which power transmission device is characterized in that the rotation axle of said reel 238 is arranged substantially perpendicular in relation to its base onto which the device is placed when the device is in the operating position; and in that said crank 240 is a hydraulic crank.

Due to the high torque generated by the hydraulic crank, power transmission devices according to the embodiments are suitable for use in cleaning large pipes, such as sewer trunk line pipes and ground sewers, when equipped with a suitable tool.

It is obvious to the person skilled in the ad that, due to the illustrative clarity of the description, the exemplified embodiments presented above are relatively simple both in structure and function. Following the model presented in this patent application, it is possible to construct solutions, which are different and quite complicated and which utilize the inventive thought presented in this patent application.

The invention claimed is:

1. A power transmission device, comprising, a cable, and a duct at least partially surrounding the cable, a rotatable reel, the cable and the duct being reeled onto the reel, and a hydraulic motor connected to ahead end of the cable for rotating the cable.

2. A device according to claim 1, wherein the rotatable reel is arranged to be rotated by an electric motor.

3. A device according to claim 2, wherein the electric motor, arranged for rotating the reel, is guided by pedals.

4. A device according to claim 1, wherein the hydraulic motor is arranged to rotate along with the reel.

5. A device according to claim 1, wherein there is a safety switch in operative engagement with the hydraulic motor and the head end of the cable which disconnects the cable from the hydraulic motor when torsion exceeds a limit.

6. A device according to claim 1, wherein there are means for attaching a tool to the cable.

7. A device according to claim 1, wherein the device further comprises means for cooling a hydraulic fluid.

8. A device according to claim 1, wherein the device further comprises a frame, and triple wheels in operative engagement with the frame for moving the device.

9. A device according to claim 1, wherein a rotation axle of the reel is arranged substantially perpendicular in relation to a base onto which the device is placed when the device is in an operating position.

10. A power transmission device comprising, a cable, and a duct at least partially surrounding the cable, a reel arranged to be rotated, into which the cable with its duct can be reeled, a guide for feeding the cable onto and/or off the reel, and a hydraulic motor in connection with a head end of the cable for rotating the cable, the reel arranged to be rotated having an outer ring and an inner ring, the outer ring and the inner ring having a space defined therebetween, and the cable having the duct is reelable into the space between the inner and outer rings.

11. A device according to claim 10, wherein a difference between a radii of the outer ring and the inner ring of the reel is less than double in relation to a diameter of the duct.

* * * * *